US009044971B2

(12) United States Patent
Tsuchiya

(10) Patent No.: US 9,044,971 B2
(45) Date of Patent: Jun. 2, 2015

(54) INK-JET RECORDING APPARATUS

(71) Applicant: MIMAKI ENGINEERING CO., LTD., Nagano (JP)

(72) Inventor: Atsushi Tsuchiya, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/287,067

(22) Filed: May 26, 2014

(65) Prior Publication Data

US 2014/0354743 A1 Dec. 4, 2014

(30) Foreign Application Priority Data

May 28, 2013 (JP) ..... 2013-112298

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
USPC ..... 347/102, 101, 16
See application file for complete search history.

(56) References Cited

U.S. PATENT DOCUMENTS

2006/0023045 A1* 2/2006 Yokoyama et al. ..... 347/102
2010/0289860 A1* 11/2010 Takezawa et al. ..... 347/102

FOREIGN PATENT DOCUMENTS

JP 2008-173968 7/2008
JP 2009-051095 3/2009
JP 2012-520779 9/2012

* cited by examiner

*Primary Examiner* — Henok Legesse
(74) *Attorney, Agent, or Firm* — Jianq Chyun IP Office

(57) ABSTRACT

Provided is an ink-jet printer including a printer head which ejects ink onto a medium while moving relative to the medium in a main-scanning direction, an LED module which exposes the ink ejected onto the medium to light while moving in the main-scanning direction together with the printer head so as to cure the ink, and LED light sources which are provided to the LED module at a position near the medium, which are plurally arranged at least in the main-scanning direction, and which are divided into a plurality of areas in accordance with an arrangement position with respect to the LED module to adjust an amount of light during light emission for each area.

7 Claims, 11 Drawing Sheets

INK-JET RECORDING APPARATUS

CROSS-REFERENCE TO RELATED APPLICATIONS

This application claims the priority benefit of Japan application serial no. 2013-112298, filed on May 28, 2013. The entirety of the above-mentioned patent application is hereby incorporated by reference herein and made a part of this specification.

BACKGROUND OF THE INVENTION

1. Field of the Invention

The present invention relates to an ink-jet recording apparatus.

2. Description of the Background Art

As one of the ink-jet recording apparatuses in the related art, there is an ink-jet recording apparatus including a holder that holds an ink head and ejects ink from the ink head with respect to a medium as an object to be printed on while moving in a main-scanning direction, and a lamp that moves in the main-scanning direction together with the holder and emits light for curing the ink ejected from the ink head.

For example, an ultraviolet irradiation device disclosed in JP-A-2008-173968 includes a carriage on which a printer head allowing an ultraviolet-curable ink to adhere to printing paper is mounted, a carriage motor that moves the carriage in the main-scanning direction, and an ultraviolet irradiation device that irradiates an ink-adhering surface of the printing paper with ultraviolet rays. Here, the ultraviolet irradiation device includes a plurality of ultraviolet light sources, and the plurality of ultraviolet light sources are supported by a circuit substrate in which a mounting surface of the ultraviolet light sources faces a surface of the printing paper. According to this, the plurality of ultraviolet light sources face the printing paper and are arranged in parallel in a direction parallel with the surface of the printing paper.

In addition, in an ink-jet recording apparatus disclosed in JP-A-2009-51095, recording heads corresponding to color ink of each color and an ultraviolet light source that emits ultraviolet rays for curing and fixing the ink ejected on a recording medium are arranged in a carriage that is arranged to reciprocally move in the main-scanning direction. The ultraviolet light source provided to the carriage is constituted by a plurality of LEDs, and the plurality of LEDs are arranged in rows. In addition, the plurality of LEDs are configured to change the intensity of ultraviolet rays, which are emitted, for each of the LEDs or for each block of LEDs divided into several blocks so as to change the glossiness of an image. According to this, a plurality of patches having different image glossiness are included in one test pattern image.

In addition, in an ink-jet printer disclosed in JP-T-2012-520779, a printing engine, which includes a print-head configured to spray ink onto a substrate and a light-source unit configured to cure the ink on the substrate, can move relative to the substrate, and the light-source unit is provided with a plurality of LED arrays arranged in a straight line.

SUMMARY OF THE INVENTION

However, in a case of irradiating the medium with light from a lamp to cure the ejected ink, some of the light is reflected from the medium, and is emitted to the outside of the lamp and becomes so-called stray light, which is unnecessary irradiation light, in some cases. When the ink head is irradiated with the stray light, the ink may be cured at a site other than the assumed sites, and thus it is necessary to positively prevent the stray light from occurring. On the other hand, the stray light occurs when the lamp is turned on to cure the ink. Therefore, it is very difficult to emit the light for curing the ink without occurrence of the stray light.

The invention has been made in consideration of the above-described circumstances, and an object thereof is to provide an ink-jet recording apparatus capable of performing irradiation of ink-curing light while greatly reducing stray light.

To solve the above-described problem and to accomplish the object, according to an aspect of the invention, there is provided an ink-jet recording apparatus including: a printer head which moves relative to a table on which a medium is placed, and which ejects ink onto the medium while moving relative to the medium in a main-scanning direction; irradiation means for performing exposure with respect to the ink ejected onto the medium to cure the ink while moving together with the printer head in the main-scanning direction; and light-emitting units which are provided to the irradiation means at a position near the medium, which are plurally arranged at least in the main-scanning direction, and which are divided into a plurality of areas in accordance with an arrangement position with respect to the irradiation means to adjust an amount of light during light emission for each of the area.

According to this ink-jet recording apparatus, the light emitting units are arranged at a position near the medium, and thus it is possible to limit the height of an optical path of reflected light from the medium. According to this, it is possible to suppress the light reflected from the medium from getting out from a space between the medium and the irradiation means and being stray light directly propagating in the direction of the printer head. In addition, the light-emitting units are plurally arranged in the main-scanning direction, and are divided into a plurality of areas in accordance with an arrangement position with respect to the irradiation means to adjust an amount of light for each of the areas, and thus it is possible to irradiate the irradiation range with light in an approximately uniform amount of light. Accordingly, it is possible to suppress occurrence of unevenness in irradiation caused by arranging the light-emitting units to be close to the medium in order for light not to diffuse. As a result, it is possible to perform irradiation of the ink-curing light while greatly reducing the stray light.

In addition, in the ink-jet recording apparatus, it is preferable that in the light-emitting units, the amount of light of the light-emitting units arranged near an outer end portion of the irradiation means in the main-scanning direction be set to be larger than the amount of light of the light-emitting units located near the center of the irradiation means in the main-scanning direction.

According to this ink-jet recording apparatus, the amount of light of the light-emitting units arranged near an outer end portion of the irradiation means in the main-scanning direction is set to be larger than the amount of light of the light-emitting units located near the center of the irradiation means in the main-scanning direction, and thus it is possible to irradiate an irradiation range of the irradiation means with light in a reliably uniform amount of light. As a result, it is possible to make irradiation intensity of ultraviolet rays in an irradiation range flat in a more reliable manner, and thus it is possible to cure the ink in a more reliable and uniform manner.

In addition, in the ink-jet recording apparatus, it is preferable that in the light-emitting units, the amount of light of the light-emitting units located near the center of the irradiation means in the main-scanning direction be set to be larger than the amount of light of the light-emitting units arranged near the outer end portion of the irradiation means in the main-scanning direction.

According to this ink-jet recording apparatus, the amount of light of the light-emitting units located near the center of the irradiation means in the main-scanning direction is set to be larger than the amount of light of the light-emitting units arranged near the outer end portion of the irradiation means in the main-scanning direction, and thus it is possible to reduce the amount of light that propagates in the direction of the printer head. As a result, it is possible to reduce the stray light in a more reliable manner.

In addition, it is preferable that the ink-jet recording apparatus further include light absorption means for absorbing light reflected from the medium, the light absorption means being located between the printer head and the irradiation means in the main-scanning direction.

According to this ink-jet recording apparatus, the light absorption means for absorbing light is arranged between the printer head and the irradiation means, and thus it is possible to suppress light, which is emitted from the irradiation means and is repetitively reflected between the irradiation means and the medium, from propagating in the direction of the printer head. As a result, it is possible to reduce the stray light in a more reliable manner.

In addition, in the ink-jet recording apparatus, it is preferable that the light absorption means be coated with a diffuse reflection coating material.

According to this ink-jet recording apparatus, the light absorption means is coated with the diffuse reflection coating material, and thus it is possible to suppress light, which reaches the light absorption means, from being reflected in a more reliable manner. Accordingly, it is possible to suppress light from propagating in the direction of the printer head between the irradiation means and the medium. As a result, it is possible to greatly reduce the stray light in a more reliable manner.

In addition, in the ink-jet recording apparatus, it is preferable that the light absorption means be coated with a black color.

According to this ink-jet recording apparatus, the light absorption means is coated with a black color, and thus light, which reaches the light absorption means, can be absorbed in a more reliable manner. Accordingly, it is possible to suppress light from propagating in the direction of the printer head between the irradiation means and the medium. As a result, it is possible to greatly reduce the stray light in a more reliable manner.

In addition, in the ink-jet recording apparatus, it is preferable that an ultraviolet absorbing agent be applied onto the light absorption means.

According to this ink-jet recording apparatus, the ultraviolet absorbing agent is applied onto the light absorption means, and thus the light absorption means can absorb ultraviolet rays included in light that reaches the light absorption means. According to this, in a case of curing the ink ejected onto the medium with ultraviolet rays, it is possible to suppress unnecessary ultraviolet rays from propagating in the direction of the printer head between the irradiation means and the medium. As a result, it is possible to reduce the stray light in a more reliable manner.

In addition, in the ink-jet recording apparatus, it is preferable that a surface of the light absorption means be formed in a concavo-convex shape.

According to this ink-jet recording apparatus, the surface of the light absorption means is formed in a concavo-convex shape, and thus it is possible to suppress light, which reaches the light absorption means, from being reflected in a more reliable manner, and it is possible to suppress the light from propagating in the direction of the printer head between the irradiation means and the medium. As a result, it is possible to perform irradiation of the ink-curing light while greatly reducing the stray light in a more reliable manner.

In addition, it is preferable that the ink-jet recording apparatus further include: an incidence unit which is located between the printer head and the irradiation means in the main-scanning direction, and which transmits light reflected from the medium; and an incident light capturing unit that captures light, which is transmitted through the incidence unit, on a medium side.

According to the ink-jet recording apparatus, the incident light capturing unit that absorbs light, which is transmitted through the incidence unit, from the medium side is provided, and thus it is possible to capture more light. That is, the incident light capturing unit can attenuate light by reflecting the light in a large area, and thus it is possible to capture more light. Accordingly, it is possible to reduce the stray light in the direction of the printer head from the irradiation means side in a more reliable manner. As a result, it is possible to perform irradiation of the ink-curing light while greatly reducing the stray light in a more reliable manner.

The ink-jet recording apparatus of the invention has an effect capable of performing irradiation of ink-curing light while greatly reducing stray light.

DETAILED DESCRIPTION OF THE INVENTION

Hereinafter, embodiments of an ink-jet recording apparatus according to the invention will be described in detail with reference to the attached drawings. In addition, the invention is not limited to the embodiments. In addition, constituent elements in the following embodiments include elements which can be substituted or easily substituted by those skilled in the art, and which are substantially the same as the constituent elements.

First Embodiment

Figure 1:
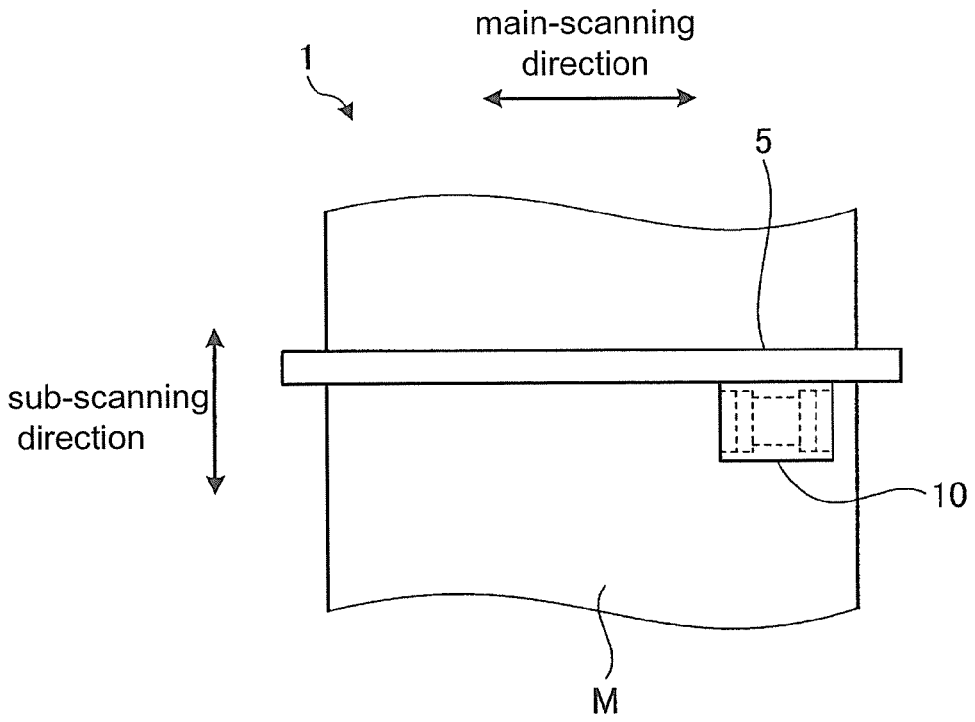
FIG. 1 is a configuration view illustrating a structure of an ink-jet printer according to a first embodiment.
Figure 2:
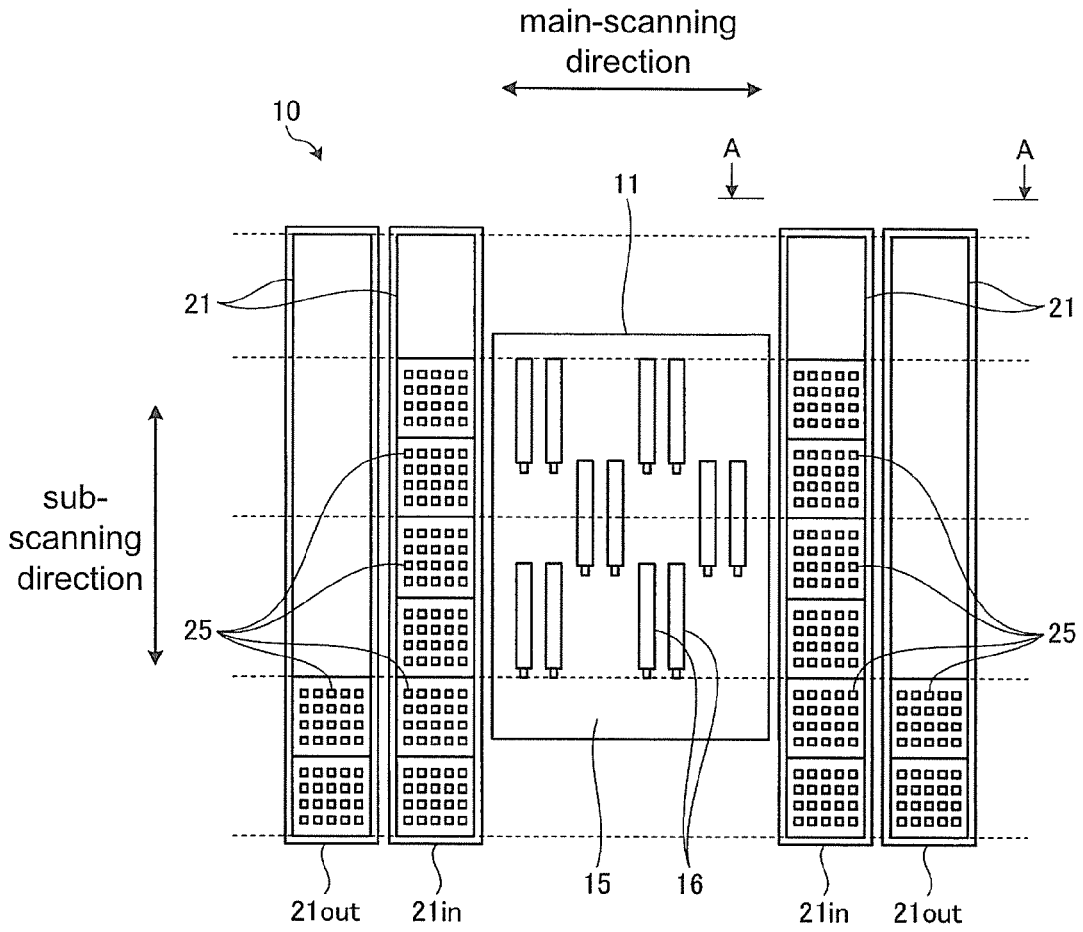
FIG. 2 is a plan view illustrating a printer head of the ink-jet printer shown in FIG. 1.

FIG. 1 is a configuration view illustrating a structure of an ink-jet printer according to a first embodiment. FIG. 2 is a plan view illustrating a printer head of the ink-jet printer shown in FIG. 1. The ink-jet printer 1, which is an ink-jet recording apparatus shown in the same drawings, includes a Y-bar 5 that extends in one direction parallel with a medium M during printing onto the medium M by the ink-jet printer 1, and the extension direction of the Y-bar 5 is a main-scanning direction in the ink-jet printer 1. In other words, the Y-bar 5 extends in the main-scanning direction.

A carriage 10, which moves along the Y-bar 5, is mounted to the Y-bar 5. Movement of the carriage 10 in the main-scanning direction can be controlled, and the carriage 10 can reciprocally move in the main-scanning direction along the Y-bar 5 by driving means such as a motor (not shown). According to this, the carriage 10 can move relative to a table (not shown) on which the medium M is placed in the main-scanning direction. On the other hand, the ink-jet printer 1 is provided with a feeding mechanism (not shown) of the medium M, and the medium M is movably retained by the feeding mechanism in a sub-scanning direction that is a direction perpendicular to the main-scanning direction.

The carriage 10 includes a holder 11 in which a printer head 15 is arranged, and ultraviolet irradiation devices 20 provided on both sides of the holder 11 in the main-scanning direction. Among these, the printer head 15 includes a plurality of ink ejection units 16, and the plurality of ejection units 16 are arranged to deviate from each other in the main-scanning direction and the sub-scanning direction, and thus a wide printing region is constituted. In addition, the ultraviolet irradiation devices 20 are symmetrically arranged on both sides of the printer head 15 on the main-scanning direction and have a symmetrical structure.

Each of the ultraviolet irradiation devices 20 includes a plurality of light-emitting diode (LED) modules 25 as irradiation means, and the plurality of LED modules 25 are arranged in a plurality of rows. Specifically, the plurality of LED modules 25 constitute inner rows 21*in* that are located near the printer head 15 in the main-scanning direction, and outer rows 21*out* that are located on a side opposite to a side, at which the printer head 15 is located in the main-scanning direction, when seen from the inner rows 21*in*. In addition, the LED modules 25 are arranged in parallel in set of two in the sub-scanning direction.

A rail 21, which extends in the sub-scanning direction, is provided to the inner rows 21*in* and the outer rows 21*out*, respectively, and the LED modules 25 of the inner rows 21*in* and the outer rows 21*out* are mounted to the respective rails 21 in a movable manner in the sub-scanning direction. A length of each of the rails 21 in the sub-scanning direction, that is, a movable range of the LED modules 25 in the sub-scanning direction is longer than a length of the printer head 15 in the sub-scanning direction. The LED modules 25 are configured as follows. Each set of the LED modules 25 can move along the rail 21, which is provided as described above, in the sub-scanning direction by driving means such as a motor (not shown), and can stop at an arbitrary position in the sub-scanning direction.

Figure 3:
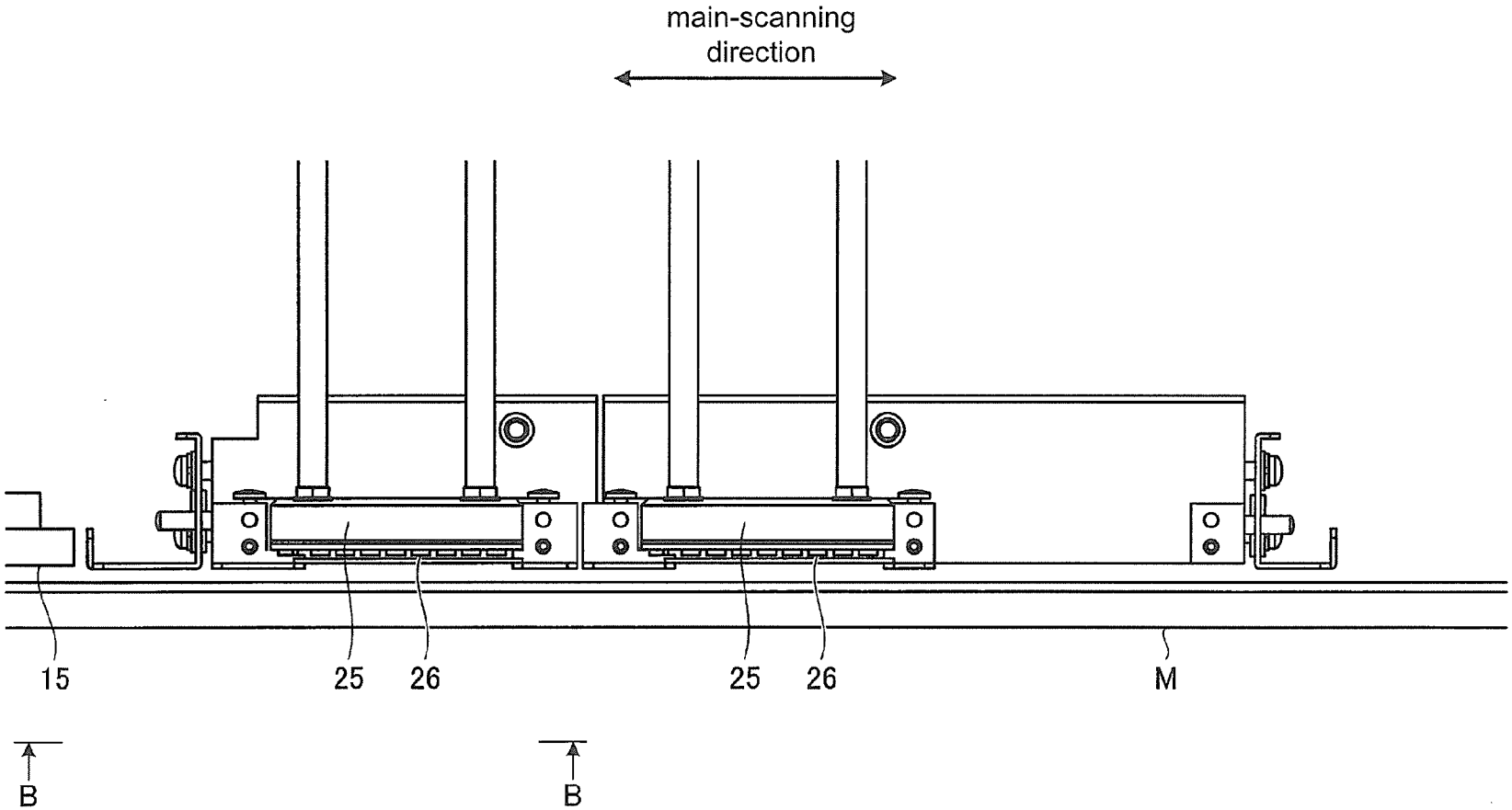
FIG. 3 is a view seen in a direction of an arrow A-A of FIG. 2.

FIG. 3 is a view seen in a direction of an arrow A-A of FIG. 2. Each of the LED modules 25 provided to the ultraviolet irradiation device 20 includes a plurality of LED light sources 26 as a light-emitting unit. The LED light sources 26 are configured to emit light including ultraviolet rays during light emission. The plurality of LED light sources 26 are arranged in parallel in a direction parallel with the medium M in a state in which printing is performed onto the medium M in the ink-jet printer 1, and are provided in a direction facing the medium M. In addition, the plurality of LED light sources 26 are provided to be located in the vicinity of the medium M that is printed, and are provided at a position close to the medium M. Specifically, the LED light sources 26 are arranged to be spaced away from the medium M by a distance of approximately 2 mm.

Figure 4:
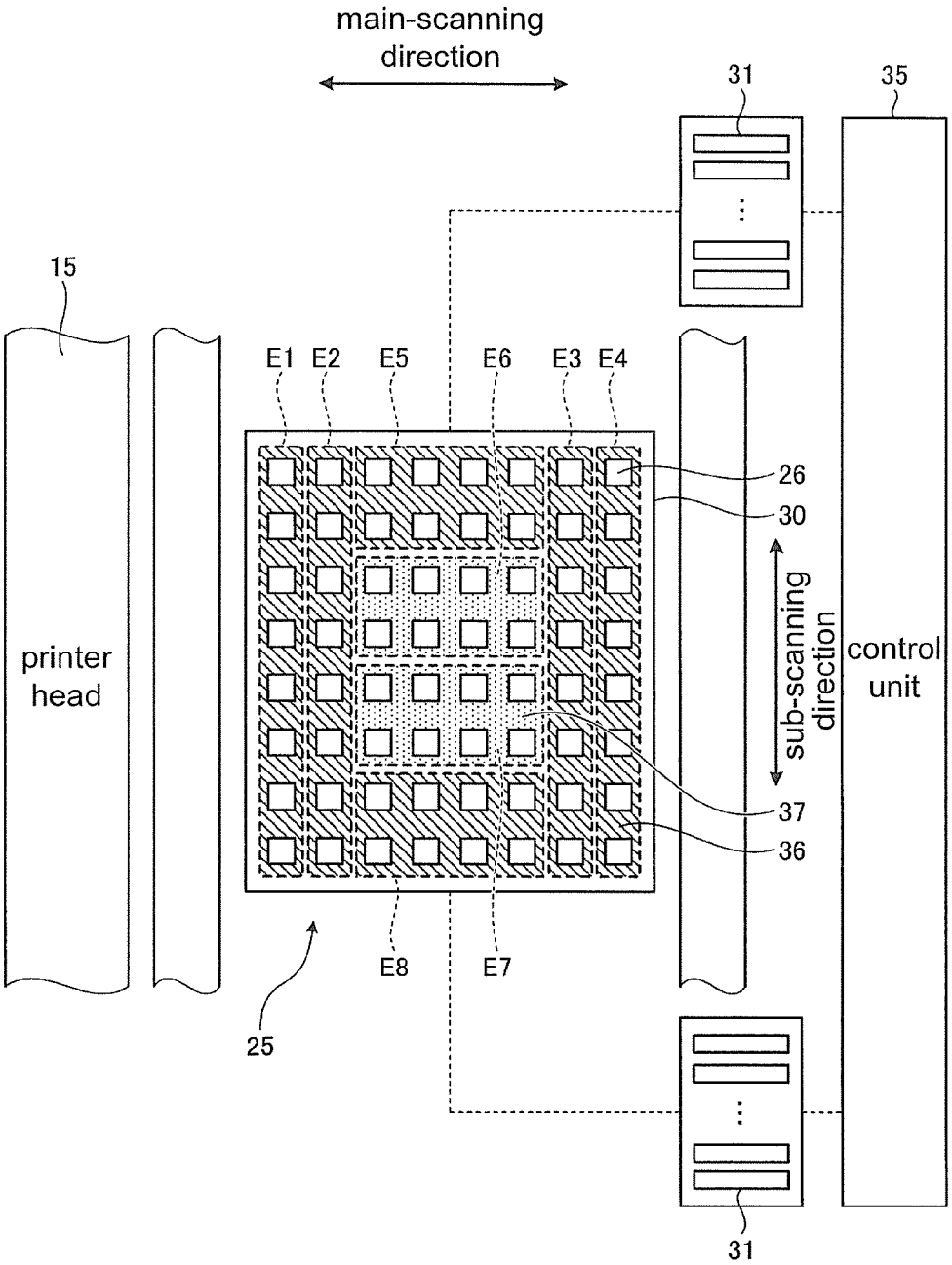
FIG. 4 is a view seen in a direction of an arrow B-B of FIG. 3.

FIG. 4 is a view seen in a direction of an arrow B-B of FIG. 3. In each of the LED modules 25, the plurality of LED light sources 26 are arranged in the vertical direction and the horizontal direction on a surface on a medium M side of the substrate 30. The plurality of LED light sources 26 are arranged in a so-called lattice shape. That is, the LED light sources 26 are arranged in parallel in the main-scanning direction and the sub-scanning direction in a plural number, respectively. In the main-scanning direction and the sub-scanning direction, the plurality of LED light sources 26 are divided into sets in which an arbitrary plural number of the LED light sources 26 are collected as a group. An irradiation unit 31 is connected to each of the sets and is capable of independently controlling the LED light sources 26 included in the set as a whole.

For example, as shown in FIG. 4, the plurality of LED light source 26 are divided into five in the main-scanning direction, and a portion divided at the central position in the main-scanning direction is divided into four in the sub-scanning direction. That is, in the ink-jet printer 1 according to the first embodiment, the plurality of LED light sources 26 provided to the LED module 25 are divided into eight (E1 to E8), and the irradiation unit 31 is connected to each set. The irradiation unit 31, which is connected to each set of the LED light sources 26 in this manner, is an electronic circuit capable of setting illuminance of the entirety of LED light sources 26 included in the set as a whole. That is, the plurality of LED light sources 26 are divided into a plurality of areas in accordance with an arrangement position in the LED module 25. With respect to the LED light sources 26 divided into the plurality of areas, adjustment of an amount of light is performed for each of the areas by the irradiation unit 31.

The irradiation unit 31 is connected to a control unit 35. The control unit 35 has a known configuration provided with a processing unit such as a central processing unit (CPU), a storage unit such as a random access memory (RAM), and the like. The control unit 35 performs movement control of the carriage 10 in the main-scanning direction, movement control of the LED module 25 in the sub-scanning direction, and feeding control of the medium M in the sub-scanning direction, or controls irradiation of the respective LED light sources 26 by transmitting a signal of a predetermined irradiation intensity to the irradiation unit 31.

For example, in the ink-jet printer 1 according to the first embodiment, among the eight sets of the plurality of LED light sources 26, two sets on each side in the main-scanning direction, that is, four sets (E1 to E4) on both sides in the main-scanning direction, and two sets (E5 and E8) on both sides in the sub-scanning direction in four central sets (E5 to E8) in the main-scanning direction become a strong light amount portion 36 in which irradiation intensity is set to be strong. In contrast, among the eight sets of the plurality of LED light sources 26, two sets (E6 and E7) on a central side in the sub-scanning direction in the four central sets (E5 to E8) in the main-scanning direction become a weak light amount portion 37 in which the irradiation intensity is set to be weaker than that of the strong light amount portion 36.

As described above, in the LED light sources 26 provided to the LED module 25, the amount of light during light emission is different in each case in accordance with an arrangement position, and in the ink-jet printer 1 according to the first embodiment, the outer peripheral portion of the LED module 25 in a plan view becomes the strong light amount portion 36 in which the amount of light is large, and the central portion becomes the weak light amount portion 37 in which the amount of light is small. According to this, in the LED light sources 26, the amount of light is larger in the LED light sources 26 that are arranged near an outer end portion of the LED module 25 in the main-scanning direction in comparison to the LED light sources 26 that are located near the central portion of the LED module 25 in the main-scanning direction.

The ink-jet printer 1 according to the first embodiment is configured as described above. Hereinafter, an operation thereof will be described. When performing printing onto the medium M by the ink-jet printer 1, the carriage 10 is moved relative to the medium M in the main-scanning direction by moving the carriage 10 along the Y-bar 5, and the medium M is moved in the sub-scanning direction, thereby performing printing in a wide range of the medium M.

Specifically, ink according to printing contents is ejected from the ejection units 16 of the printer head 15 provided to the carriage 10 while moving the carriage 10 along the Y-bar 5. For example, the printer head 15 is provided in such a manner that each of the plurality of ejection units 16 ejects ink of any color among M (magenta), C (cyan), Y (yellow), and K (black), and the printer head 15 ejects the ink of a color according to printing contents from the ejection units 16. In addition, a combination of ejection colors from the printer head 15 may be different from the above-described combination.

The printer head 15 moves in the main-scanning direction by moving the carriage 10 along the Y-bar 5 while ejecting a desired color of ink with a predetermined width in the sub-scanning direction set as one unit. When reaching an end portion of a movement range in the main-scanning direction, the carriage 10 moves in an opposite direction in the main-scanning direction. According to this, the carriage 10 reciprocates within the movement range in the main-scanning direction. In addition, the movement range in this case may be a movable range of the carriage 10 in the main-scanning direction. In addition, a printing range may be set according to the printing contents, and this printing range may be set as the movement range.

On the other hand, when the carriage 10 moves up to the end portion of the movement range and initiates movement in an opposite direction in the main-scanning direction, the medium M moves in the sub-scanning direction by a predetermined width in the sub-scanning direction which is one unit during printing by the printer head 15. The printer head 15 performs printing with the one unit set as one PASS. That is, when the printer head 15 moves in the main-scanning direction while ejecting the ink and reaches the end portion of the movement range at a predetermined PASS, the medium M moves by one PASS in the sub-scanning direction, and the printer head 15 moves in an opposite direction in the main-scanning direction while ejecting the ink. According to this, the printer head 15 performs printing of next PASS.

As described above, when the printer head 15 ejects the ink while moving in the main-scanning direction, the LED light sources 26 of the LED module 25, which moves in the main-scanning direction together with the printer head 15, is turned on to emit light from the LED light sources 26. The ink ejected onto the medium M is exposed to the light and is cured by ultraviolet rays included in the light from the LED light sources 26. The LED light sources 26 of the LED module 25 are arranged closely to the medium M, and thus light from the LED light sources 26 reach the medium M without being diffused too much. The ink on the medium M is exposed to the light that is emitted from the near LED light sources 26 and reaches the medium M without diffusion, and thus the ink is cured by ultraviolet rays included in the light.

Here, in the LED module 25, the outer peripheral portion in a plan view becomes the strong light amount portion 36, and the central portion becomes the weak light amount portion 37, and thus the medium M in the irradiation range of the LED module 25 can be irradiated with light in an approximately uniform amount of light. That is, in a case where the LED light sources 26 emit light, in the ink-jet printer 1 according to the first embodiment, the light reach the medium M without being diffused too much, but slight diffusion occurs, and thus a part of the light during light emission of the LED light sources 26 is emitted to the periphery of the LED light sources 26. Therefore, a portion of the medium M, which faces the weak light amount portion 37, is also irradiated with a part of light from the strong light amount portion 36 located at the periphery of the weak light amount portion 37 in addition to light from the weak light amount portion 37.

Similarly, a portion of the medium M, which faces the strong light amount portion 36, is also irradiated with a part of light from the weak light amount portion 37, but the light sources are not arranged on an outer side of the strong light amount portion 36, and thus the portion is not irradiated with light from an outer side of the strong light amount portion 36. Accordingly, the amount of light emitted to the portion of the medium M, which faces the weak light amount portion 37, from other than the weak light amount portion 37, becomes larger than the amount of light emitted to the portion of the medium M, which faces the strong light amount portion 36, from other than the strong light amount portion 36. Accordingly, the portion of the medium M, which faces the weak light amount portion 37, is irradiated with light in a large amount, but the amount of light in the weak light amount portion 37 is smaller than the amount of light in the strong light amount portion 36. Accordingly, in the medium M, the portion facing the weak light amount portion 37 and the portion facing the strong light amount portion 36 are irradiated with light in substantially the same amount of light, and in the medium M, an irradiation range from one LED module 25 is irradiated with light in an approximately uniform amount of light.

As described above, in the ink-jet printer 1 according to the first embodiment, adjustment of the amount of light of the LED light sources 26 is performed for each of a plurality of divided areas, and the amount of light of the LED light sources 26 arranged near the outer end portion of the LED module 25 is set to be larger than the amount of light of the LED light sources 26 arranged near the center of the LED module 25. Accordingly, each LED module 25 emits light in a uniform amount of light with respect to each irradiation range. As described above, in a case where light is emitted from the LED light sources 26 to the medium M, a part of the light is reflected on a surface of the medium M, but the LED light sources 26 are arranged closely to the medium M, and thus an optical path of the reflected light is limited in the height thereof. Accordingly, the reflected light that is reflected from the medium M is less likely to diffuse, and thus the reflected light is less likely to get out from a space between the medium M and the LED module 25 to the outside.

When curing the ink with the light from the LED module 25, full curing is performed after being subjected to temporary curing. The temporary curing and the full curing are realized by adjusting the amount of light from the LED module 25, or by performing exposure of the ejected ink in combination with a plurality of the LED modules 25 by appropriately moving the LED module 25 provided to the outer rows 21*out* and the inner rows 21*in* of the ultraviolet irradiation device 20, respectively, in the sub-scanning direction. The amount of light during irradiation by the LED modules 25 or the position of the LED modules 25 in the sub-scanning direction is controlled by the control unit 35 in accordance with a printing state.

With regard to the movement of the LED modules 25 in the sub-scanning direction, for example, the temporary curing is performed immediately after ejection onto the medium M from the printer head 15, and when the carriage 10 moves to an end portion to which the carriage 10 can move in the main-scanning direction, and then moves in an opposite direction and returns to a position at which the temporary curing of the ink is performed, the full curing is performed. That is, the temporary curing is performed at the same PASS as the PASS at which the ink is ejected from the printer head 15, and the full curing is performed with respect to the ink on the medium M which was subjected to the temporary curing at the immediately previous PASS.

With regard to a combination of the LED modules 25 that perform the temporary curing and the full curing, for example, at the same position in the sub-scanning direction as that of the ejection unit 16 ejecting the ink during current printing, only the LED modules 25 of the inner row 21 in are located, and the LED modules 25 in the outer rows 21*out* are not located. According to this, immediately after ejecting the ink, exposure is performed by only the LED modules 25 in the inner rows 21*in*, and thus the amount of light is not great so much. As a result, the ink is not completely cured, and thus the temporary curing is performed.

In the sub-scanning direction, the LED modules 25 in the outer rows 21*out* are located at a position at which exposure can be carried out with respect to the ink which is ejected onto the medium M and is subjected to the temporary curing at the immediately previous PASS. In addition, among the LED modules 25 in the inner rows 21*in*, LED modules 25 different from the LED modules 25 that perform the temporary curing are also located at the same position in the sub-scanning direction.

At the subsequent PASS after the PASS at which the temporary curing of the ink is performed, exposure is performed with respect to the ink by the LED modules 25 in the outer rows 21*out* and the LED modules 25 in the inner rows 21*in*. According to this, at the subsequent PASS after performing the temporary curing, exposure is performed in an amount of light which is larger than the amount of light during the temporary curing, and thus the ink is completely cured. As a result, the full curing is performed. That is, the LED modules 25, which perform the full curing, perform the exposure in a state of being disposed at a position deviated by one PASS toward the movement direction of the medium M in the sub-scanning direction with respect to the LED modules 25 that perform the temporary curing.

In addition, for each PASS, a movement direction of the carriage 10 becomes an opposite direction in the main-scanning direction, but the ultraviolet irradiation device 20 are arranged on both sides of the printer head 15 in the main-scanning direction, and thus the LED modules 25 that perform the exposure with respect to the ink are exchanged for each PASS. For example, when the temporary curing is performed by turning on the LED light sources 26 of the LED modules 25 at an arbitrary PASS, at the subsequent PASS, the temporary curing is performed by the LED modules 25 of which position with respect to the printer head 15 in the main-scanning direction becomes opposite.

In addition, the temporary curing or the full curing may be carried out by a method other than the above-described method. With regard to the temporary curing or the full curing, it is preferable that the exposure by the LED modules 25 be performed by appropriately adjusting the LED modules 25 that are used or the amount of light in accordance with a material or form of a surface of the medium M, ink that is used, and a desired finish state of printing.

In the ink-jet printer 1 according to the first embodiment, since the LED light sources 26 are arranged at positions close to the medium M, it is possible to limit the height of the optical path of reflected light from the medium M. Accordingly, it is possible to suppress the light reflected from the medium M from getting out from a space between the medium M and the LED modules 25 and being stray light directly propagating in the direction of the printer head 15. In addition, the LED light sources 26 are divided into a plurality of areas in accordance with an arrangement position in each of the LED modules 25, and are independently controlled for each of areas. Accordingly, adjustment of an amount of light is performed for each of the areas, and thus an irradiation range of the LED module 25 may be irradiated with light in an approximately uniform amount of light. According to this, it is possible to suppress occurrence of unevenness in irradiation caused by arranging the LED light sources 26 to be close to the medium M in order for light not to diffuse. As a result, it is possible to perform irradiation of the ink-curing light while greatly reducing the stray light.

In addition, since the LED light sources 26 are arranged closely to the medium M, and thus the medium M may be efficiently irradiated with irradiation light from the LED light source 26, and thus it is possible to use small-output LED light sources 26. As a result, small power consumption or a small amount of heat generation may be realized.

In addition, the amount of light during light emission of the LED light sources 26 is set to be different from each other in accordance with the arrangement position of the LED light sources 26 so as to irradiate the irradiation range with light in an approximately uniform amount of light, and thus it is possible to suppress unevenness in curing of ink droplets landing on the medium M due to irradiation unevenness in which the amount of light is different in each irradiation position. As a result, it is possible to make irradiation intensity of ultraviolet rays in an irradiation range flat, and thus it is possible to cure the ink in a more reliable and uniform manner.

In addition, the LED light sources 26 are allowed to emit light in such a manner that the amount of light of the LED light sources 26 arranged near the outer end portion of the LED module 25 is larger than that of the LED light sources 26 located near the center of the LED module 25, and thus it is possible to irradiate the irradiation range of the LED module 25 with light in a uniform amount of light in a more reliable manner. As a result, it is possible to make the irradiation intensity of ultraviolet rays in the irradiation range flat in a more reliable manner, and thus it is possible to cure the ink in a more reliable and uniform manner.

In addition, the LED light sources 26 are arranged in such a manner that a distance with the medium M becomes approximately 2 mm, and thus it is possible to limit the height of the optical path of the reflected light from the medium M in a more appropriate manner. Accordingly, it is possible to suppress the light reflected from the medium M from being stray light directly propagating in the direction of the printer head 15 in a more reliable manner. As a result, it is possible to perform irradiation of the ink-curing light while greatly reducing the stray light in a more reliable manner.

Second Embodiment

An ink-jet printer 1 according to a second embodiment has approximately the same configuration as the ink-jet printer 1 according to the first embodiment, but is characterized in that a light absorption unit that absorbs light is provided between the printer head 15 and the LED module 25. Other configurations are similar to that of the first embodiment, and thus a description thereof will not be repeated and the same reference numerals will be given thereto.

Figure 5:
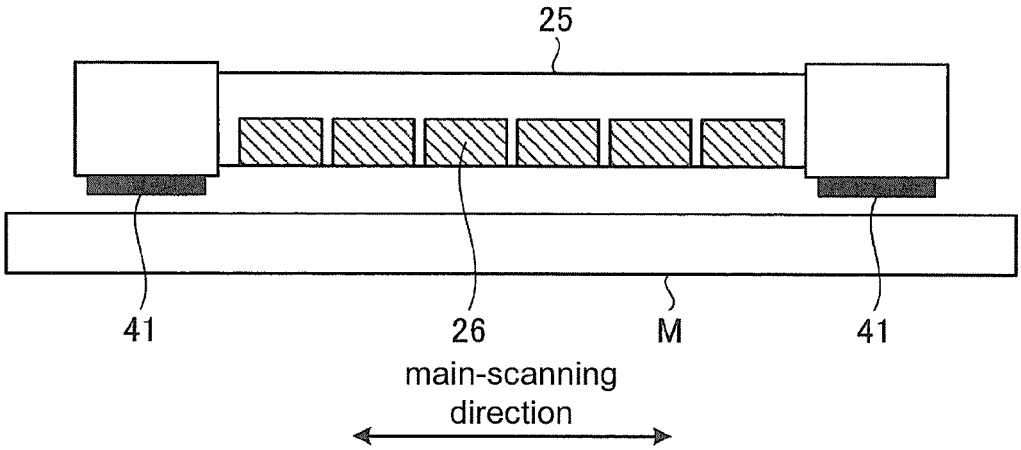
FIG. 5 is a cross-sectional view of an LED module provided to an ink-jet printer according to a second embodiment, and is an explanatory view of a light absorption unit.

FIG. 5 is a cross-sectional view of an LED module provided to the ink-jet printer according to the second embodiment, and is an explanatory view of the light absorption unit. As is the case with the ink-jet printer 1 according to the first embodiment, in the ink-jet printer 1 according to the second embodiment, the plurality of LED light sources 26 are arranged in the LED module 25 to be close to the medium M. In addition, in the ink-jet printer 1 according to the second embodiment, the light absorption unit 41, which is light absorption means for absorbing light reflected from the medium M, is arranged on both sides of the LED module 25 in the main-scanning direction. According to this, the light absorption unit 41 is arranged also between the printer head 15 and the LED module 25 in the main-scanning direction.

The light absorption unit 41 is arranged at a position facing the medium M, that is, the light absorption unit 41 is arranged at a position capable of receiving light that is emitted from the LED light sources 26 and is reflected from the medium M. That is, the light absorption unit 41 is formed as a surface facing the medium M in a direction approximately parallel with the medium M. According to this, the light absorption unit 41 can absorb light reflected from the medium M.

Specifically, the light absorption unit 41 is coated with a diffuse reflection coating material such as a black non-glossy coating material. According to this, the light absorption unit 41 is less likely to reflect light received from the outside. That is, the black color is a color capable of absorbing light of wavelength of approximately all colors included in the light that is irradiated, and light received from the outside is less likely to be reflected. In addition, a surface of the diffuse reflection coating material after coating has a fine concavo-convex shape, and thus it is possible to reflect the light, which is emitted, in a state of being diffused in various directions. Accordingly, light, which is received from the outside, is less likely to be reflected in a specific direction. According to this, the light absorption unit 41 can absorb the light that is received from the outside without reflecting the light in a specific direction. In addition, in this case, the black color of the light absorption unit 41 is not limited to an apparent black color, and may be a blackish color such as gray. In addition, the black color that is stated here represents a color having a reflection concentration capable of absorbing 90% or more of wavelengths emitted from the LED light sources 26, and it is preferable to have a reflection concentration capable of absorbing 97% to 98% of a wavelengths emitted from the LED light sources 26.

The ink-jet printer 1 according to the second embodiment is configured as described above. Hereinafter, an operation thereof will be described. When performing printing onto the medium M by the ink-jet printer 1, the printer head 15 is moved in the main-scanning direction while ejecting ink from the printer head 15. In addition, the LED light sources 26 of the LED module 25, which moves together with the printer head 15 in the main-scanning direction, are turned on to emit light from the LED light sources 26, thereby curing the ink on the medium M with ultraviolet rays included in the light from the LED light sources 26.

Here, the LED light sources 26 are close to the medium M, and thus the ultraviolet rays from the LED light sources 26 in a case of turning on the LED light sources 26 of the LED module 25 reach the medium M without being diffused too much. The ultraviolet rays reach the medium M in a direction that is approximately perpendicular to a surface of the medium. M. According to this, reflection from the surface of the medium M is less, but a part of light is reflected from the surface of the medium M. The light reflected in this manner repeats reflection between the medium M and the LED module 25, and propagates in a direction of getting out from a space between the medium M and the LED module 25.

A part of the light that repeats reflection, which propagates in the main-scanning direction, is reflected from the medium M at a position in the vicinity of an end portion of the LED module 25 in the main-scanning direction, and propagates toward the light absorption unit 41. Since the light absorption unit 41 is coated with the black diffuse reflection coating material, light that reach the light absorption unit 41 is not reflected too much at the light absorption unit 41, and is absorbed at the light absorption unit 41. The printer head 15 is located on end side of the LED module 25 in the main-scanning direction, but the light that propagates in the main-scanning direction while repeating reflection is leaked from a space between the LED module 25 and the medium M, and is absorbed at the light absorption unit 41 without propagating toward the printer head 15. That is, the light that propagates in the main-scanning direction while repeating reflection is leaked from a space between the LED module 25 and the medium M, and is absorbed at the light absorption unit 41 without generation of stray light.

In the ink-jet printer 1 according to the second embodiment, the light absorption unit 41 that absorbs light is arranged between the printer head 15 and the LED module 25. Accordingly, it is possible to suppress light, which is emitted from the LED module 25 and repeats reflection between the LED module 25 and the medium M, from propagating in the direction of the printer head 15. As a result, it is possible to perform irradiation of the ink-curing light while greatly reducing the stray light.

In addition, the light absorption unit 41 is coated with the diffuse reflection coating material. Accordingly, reflection of the light, which reaches the light absorption unit 41, can be suppressed in a more reliable manner, and thus it is possible to suppress the light from a space between the LED module 25 and the medium M from propagating toward the printer head 15. In addition, the light absorption unit 41 is coated with a black color, and thus the light, which reaches the light absorption unit 41, is absorbed in a more reliable manner. According to this, it is possible to suppress the light from propagating toward the printer head 15 between the LED module 25 and the medium M. As a result, it is possible to perform irradiation of the ink-curing light while greatly reducing the stray light in a more reliable manner.

Third Embodiment

An ink-jet printer 1 according to third embodiment has approximately the same configuration as the ink-jet printer 1 according to the first embodiment, but is characterized in that an incidence unit that transmits light is provided between the printer head 15 and the LED module 25, and an incident light capturing unit that captures light transmitted through the incidence unit is provided. Other configurations are similar to that of the second embodiment, and thus a description thereof will not be repeated and the same reference numerals will be given thereto.

Figure 6:
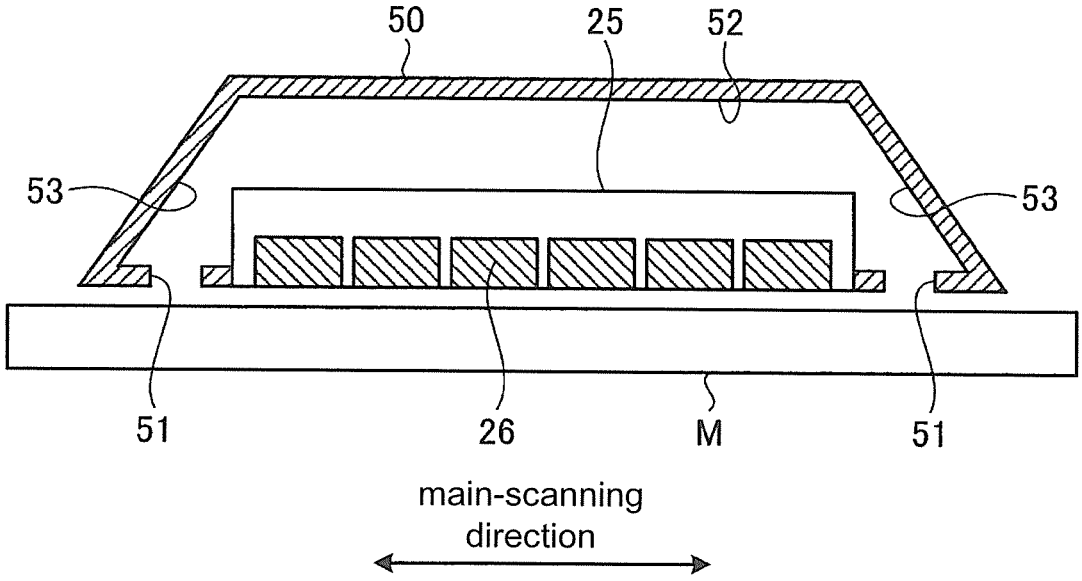
FIG. 6 is a cross-sectional view of an LED module provided to an ink-jet printer according to a third embodiment, and is an explanatory view of an incidence unit and an incident light capturing unit.

FIG. 6 is a cross-sectional view of an LED module provided to the ink-jet printer according to the third embodiment, and is an explanatory view of the incidence unit and the incident light capturing unit. As is the case with the ink-jet printer 1 according to the first embodiment, in the ink-jet printer 1 according to the third embodiment, the plurality of LED light sources 26 are arranged in the LED module 25 to be close to the medium M. In addition, in the ink-jet printer 1 according to the third embodiment, the light capturing unit 50, which captures light, is provided across a surface opposite to a surface on an irradiation side in the LED module 25 from both sides of the LED module 25 in the main-scanning direction.

An inner side of the light capturing unit 50 is a space. The space on the inner side of the light capturing unit 50 becomes an incident light capturing chamber 52, which is an incident light capturing unit formed across a surface opposite to a surface on a side facing the medium M in the LED module 25 from lateral sides of the LED module 25.

Among inner surfaces of the light capturing unit 50 which form the incident light capturing chamber 52, each inner surface located on a lateral side of the LED module 25 becomes a capturing chamber inclined surface 53 that is a surface inclined both in a direction parallel with the medium M such as the main-scanning direction and the sub-scanning direction, and in a direction perpendicular to the direction. The capturing chamber inclined surface 53 is located on a lateral side of the LED module 25, and becomes a surface inclined in directions facing both of the central direction in a plan view of the LED module 25 and a direction in which the medium M is arranged.

In addition, in the light capturing unit 50, the incidence unit 51, which is a hole through which light reflected from the medium M is transmitted, is formed at a position facing the medium M on both sides of the LED module 25 in the main-scanning direction. The incidence unit 51 is formed as a hole which transmits light on a medium M side, and which communicates with a space of a portion on the medium M side and the inner space of the incident light capturing chamber 52. In addition, the incidence unit 51 is formed at a portion that is located between the capturing chamber inclined surface 53 of the incident light capturing chamber 52 and the medium M in a direction perpendicular to a direction parallel with the medium M during printing, that is, in a direction perpendicular to a surface of the medium M. According to this, the capturing chamber inclined surface 53 of the incident light capturing chamber 52 is formed to face the medium M through the incidence unit 51. The incident light capturing chamber 52 formed on an inner side of the light capturing unit 50 is configured to receive light, which is incident to the inside through the incidence unit 51 from the medium M side, at the capturing chamber inclined surface 53, thereby capturing the light inside the incident light capturing chamber 52.

The ink-jet printer 1 according to the third embodiment is configured as described above. Hereinafter, an operation thereof will be described. When performing printing onto the medium M by the ink-jet printer 1, the LED light sources 26 of the LED module 25 are turned on while ejecting ink from the printer head 15, thereby curing the ink on the medium M with ultraviolet rays included in the light from the LED light sources 26.

In addition, a part of light during light emission of the LED light sources 26 of the LED module 25 is reflected from a surface of the medium 1M and repeats reflection between the medium M and the LED module 25, and propagates in a direction of getting out from a space between the medium M and the LED module 25. A part of the light that repeats reflection, which propagates in the main-scanning direction, is reflected from the medium M at a position in the vicinity of an end portion of the LED module 25 in the main-scanning direction, and propagates toward the incidence unit 51 of the light capturing unit 50. The incidence unit 51 is a hole that communicates with the inside of the incident light capturing chamber 52 and the space at the portion on the medium M side, and thus the light reaching the incidence unit 51 enters the incident light capturing chamber 52 through the incidence unit 51.

First, the light that enters the incident light capturing chamber 52 reaches the capturing chamber inclined surface 53, which faces the medium M, through the incidence unit 51. The capturing chamber inclined surface 53 is inclined in a direction perpendicular to the surface of the medium M, and thus the light reaching the capturing chamber inclined surface 53 is reflected toward a direction other than the direction of the medium M. According to this, the light, which enters the incident light capturing chamber 52, is reflected in an inner direction of the incident light capturing chamber 52 due to the capturing chamber inclined surface 53, reaches another inner surface of the incident light capturing chamber 52, and is reflected again from the inner surface.

In the incident light capturing chamber 52, as a communication unit that communicates with the outside, only the incidence unit 51 is formed, and thus the light, which enters the incident light capturing chamber 52 and is reflected from the inner surface of the incident light capturing chamber 52, does not get out to the outside from the incidence unit 51, and repeats reflection from the inner surface of the incident light capturing chamber 52. The light, which enters the incident light capturing chamber 52, is attenuated during repeating the reflection inside the incident light capturing chamber 52 as described above. According to this, the incident light capturing chamber 52 captures light, which is transmitted through the incidence unit 51, on the medium M side, and the light capturing unit 50 absorbs the light inside the incident light capturing chamber 52 in accordance with the capturing of the light in the incident light capturing chamber 52.

The printer head 15 is located on one end side of the LED module 25 in the main-scanning direction, but the light, which propagates in the main-scanning direction while repeating reflection, enters the incident light capturing chamber 52 from the incidence unit 51 without being leaked from a space between the LED module 25 and the medium M and propagating toward the printer head 15, and is absorbed in the incident light capturing chamber 52. That is, the light that propagates in the main-scanning direction while repeating reflection is captured by the light capturing unit 50 without being leaked from a space between the LED module 25 and the medium M and becoming the stray light.

The ink-jet printer 1 according to the third embodiment is provided with the incident light capturing chamber 52 adsorbing light, which is transmitted through the incidence unit 51, on the medium M side, and thus it is possible to capture more light. That is, since the incident light capturing chamber 52 reflects the light, which is transmitted through the incidence unit 51, at the capturing chamber inclined surface 53 in a direction other than the medium M, it is possible to attenuate the light by reflecting the light at a large area while trapping the light, and thus it is possible to capture more light. According to this, it is possible to reduce the stray light in the direction of the printer head 15 from the LED module 25 side in a more reliable manner. As a result, it is possible to perform irradiation of the ink-curing light while greatly reducing the stray light in a more reliable manner.

Modification Example

Figure 7:
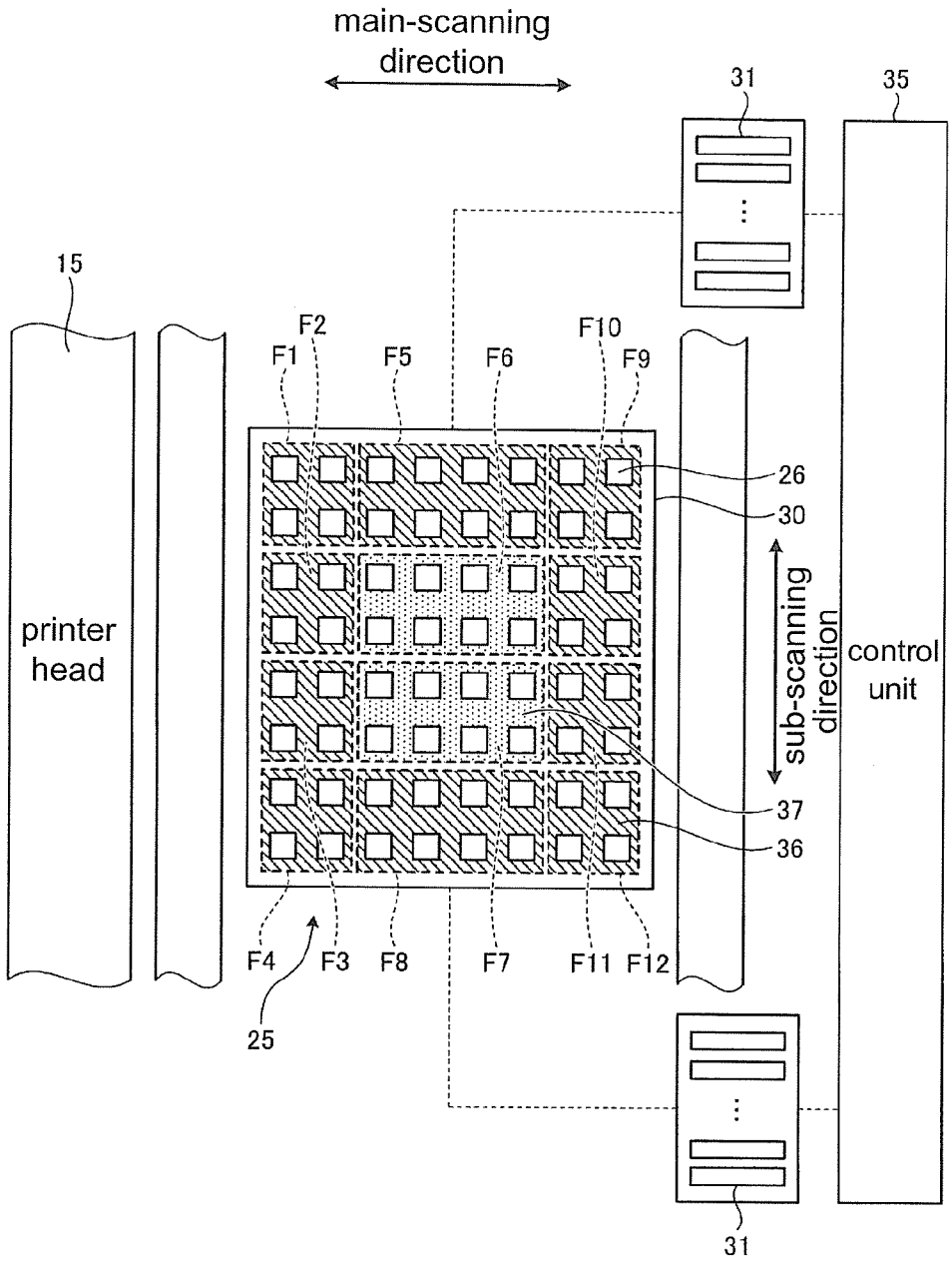
FIG. 7 is an explanatory view of a case of controlling LED light sources in a 12-division manner as a modification example of the ink-jet printer according to the first embodiment.

In addition, in the above-described ink-jet printer 1, the plurality of LED light sources 26 of the LED module 25 are divided into eight areas, and each of the areas is independently controlled. However, the division type of the LED light sources 26 may be a type other than the above-described type. FIG. 7 is an explanatory view in a case of controlling the LED light sources in a 12-division manner as a modification example of the ink-jet printer according to the first embodiment. For example, as shown in FIG. 7, the plurality of LED light sources 26 provided to the LED module 25 may be divided into twelve (F1 to F12) in such a manner that the LED light sources 26 are divided into three in the main-scanning direction and are divided into four in the sub-scanning direction, and each set may be independently controlled. In this case, outer peripheral 10 sets, which include each one row on both sides in the main-scanning direction (F1 to F4, and F9 to F12), and each one row on both sides in the sub-scanning direction (F1, F5, F9, F4, F8, and F12), may be set to the strong light amount portion 36, and two sets (F6 and F7), which are located at the central portion in both of the main-scanning direction and the sub-scanning direction, may be set as the weak light amount portion 37.

Figure 8:
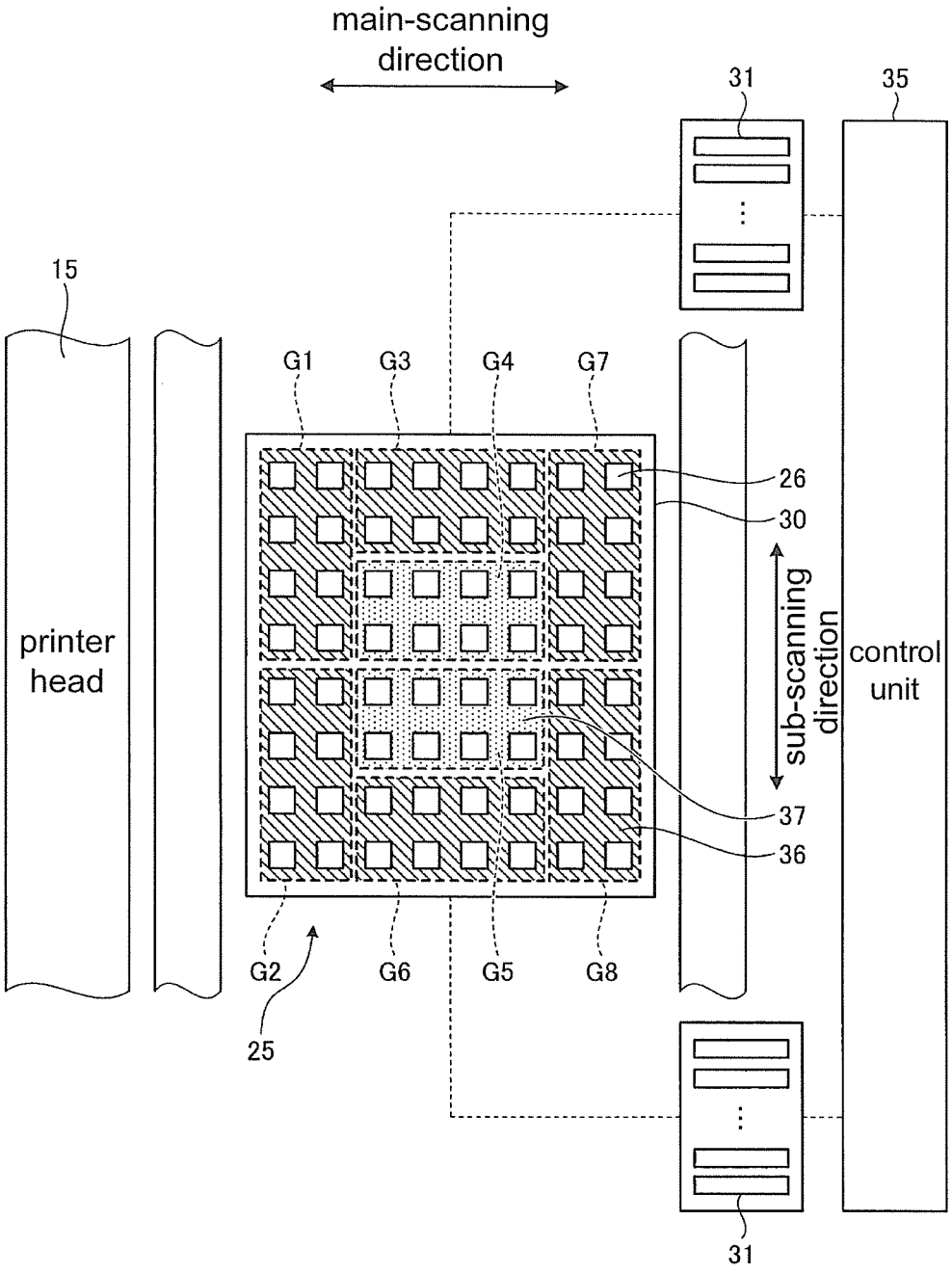
FIG. 8 is an explanatory view of a case of controlling the LED light sources in an 8-division manner as a modification example of the ink-jet printer according to the first embodiment.

FIG. 8 is an explanatory view in a case of controlling the LED light sources in an 8-division manner as a modification example of the ink-jet printer according to the first embodiment. For example, as shown in FIG. 8, the LED light sources 26 may be divided into eight (G1 to G8) in such a manner that the LED light sources 26 are divided into three in the main-scanning direction, each portion located on both sides in the main-scanning direction is divided into two in the sub-scanning direction, and a portion located at the center in the main-scanning direction is divided into four in the sub-scanning direction. In this case, outer peripheral six sets, which include each one row on both sides in the main-scanning direction (G1, G2, G7, and G8) and each one row on both sides in the sub-scanning direction (G1, G3, G7, G2, G6, and G8), may be set as the strong light amount portion 36, and two sets (G4 and G5) located at the central portion in both of the main-scanning direction and the sub-scanning direction may be set as the weak light amount portion 37.

Figure 9:
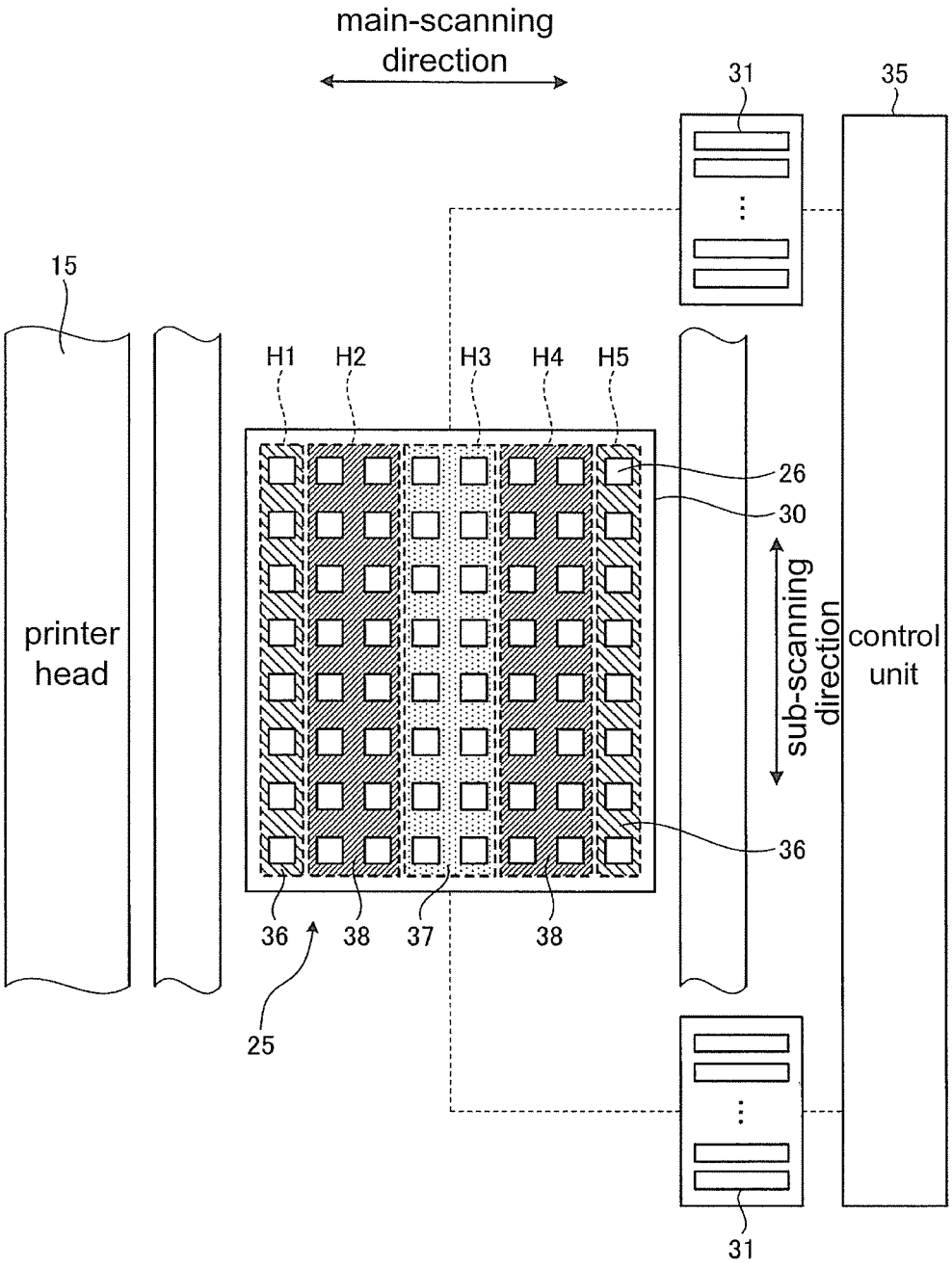
FIG. 9 is an explanatory view of a case of controlling the LED light sources in a 5-division manner as a modification example of the ink-jet printer according to the first embodiment.

In addition, the LED module 25 may be configured in a configuration other than the configuration in which the strong light amount portion 36 is provided to surround the weak light amount portion 37. FIG. 9 is an explanatory view in a case of controlling the LED light sources in a 5-division manner as a modification example of the ink-jet printer according to the first embodiment. For example, as shown in FIG. 9, the LED module 25 may be divided into five (H1 to H5) by division into five in the main-scanning direction. In this case, a total of two sets (H1 and H5), which include each one set on both sides in the main-scanning direction, may be set as the strong light amount portion 36, and one set (H3) located at the center in the main-scanning direction may be set as the weak light amount portion 37. In addition, two sets (H2 and H4) each being located between the strong light amount portion 36 and the weak light amount portion 37 in the main-scanning direction may be set as an intermediate light amount portion 38 in which the amount of light is set to be weaker than that of the strong light amount portion 36 and the amount of light is set to be stronger than that of the weak light amount portion 37, that is, the amount of light becomes an intermediate light amount between the strong light amount portion 36 and the weak light amount portion 37.

Figure 10:
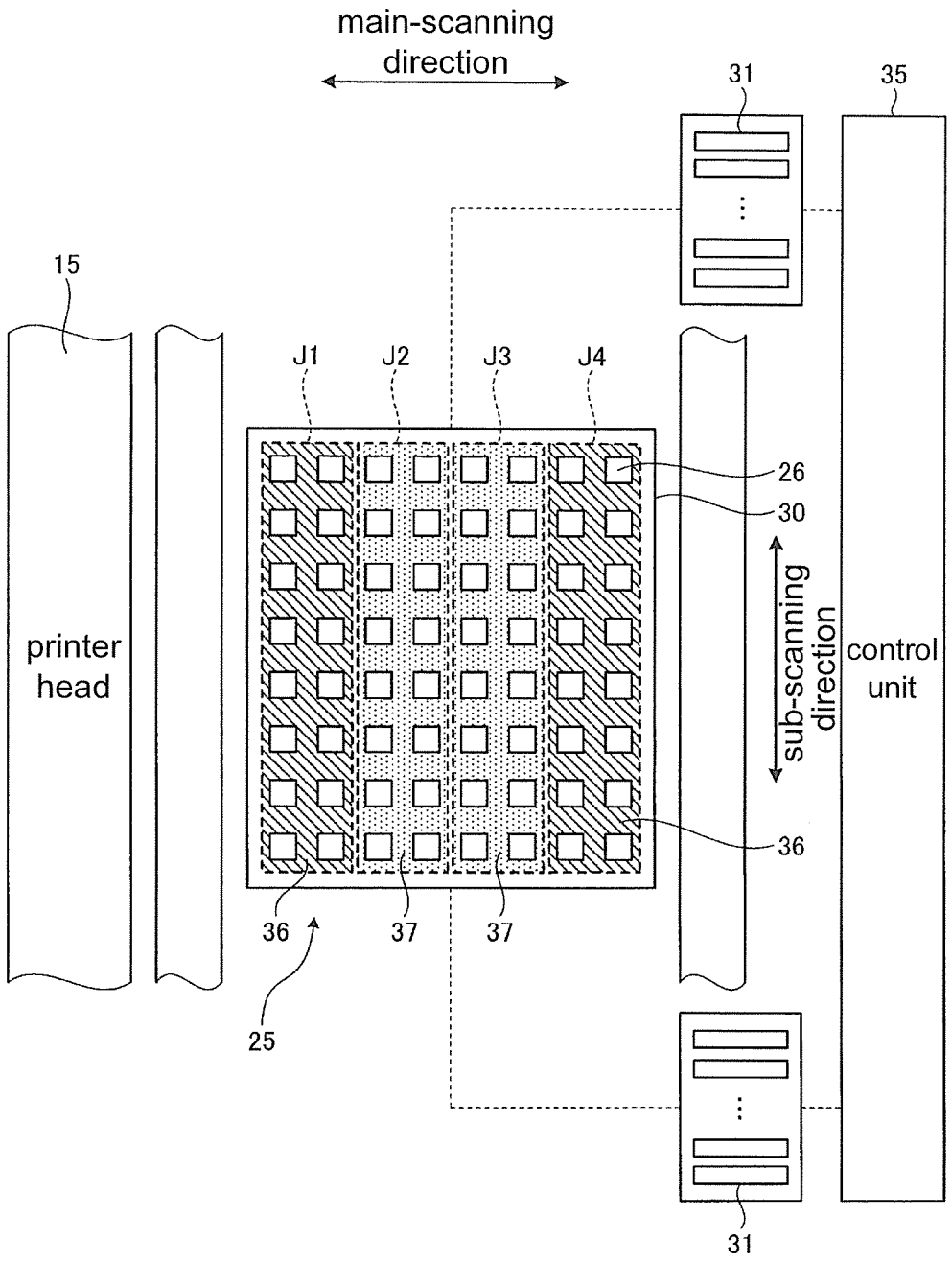
FIG. 10 is an explanatory view of a case of controlling the LED light sources in a 4-division manner as a modification example of the ink-jet printer according to the first embodiment.

FIG. 10 is an explanatory view in a case of controlling the LED light sources in a 4-division manner as a modification example of the ink-jet printer according to the first embodiment. For example, as shown in FIG. 10, the LED module 25 may be divided into four (J1 to J4) by division into four in the main-scanning direction. In this case, a total of two sets (J1 and J4), which include each one set on both sides in the main-scanning direction, may be set as the strong light amount portion 36, and two sets (J2 and J3) located on the central side in the main-scanning direction may be set as the weak light amount portion 37.

Even when dividing the area during control of the LED light sources 26 like anyone of the modification examples, the amount of light is set in such a manner that the amount of light of the LED light sources 26 arranged near the outer end portion of the LED module 25 in the main-scanning direction becomes larger than that of the LED light sources 26 arranged near the center of the LED module 25, and thus the irradiation range of the LED module 25 can be uniformly irradiated with light. According to this, it is possible to make irradiation intensity of ultraviolet rays flat, and thus it is possible to improve printing quality.

In addition, in contrast, the LED light sources 26 may be set in such a manner that the amount of light of the LED light sources 26 located near the center of the LED module 25 in the main-scanning direction becomes larger than that of the LED light sources 26 arranged near the outer end portion of the LED module 25 in the main-scanning direction. Specifically, the area during control of the LED light sources 26 is divided, and the position near the end portion of the LED module 25 in the main-scanning direction or the position near the end portion of the LED module 25 in the sub-scanning direction may be set as the weak light amount portion 37, and the position near the center in the main-scanning direction or the sub-scanning direction may be set as the strong light amount portion 36. In this manner, when reducing the amount of light of the LED light sources 26 arranged near the outer end portion of the LED module 25 in the main-scanning direction, light that propagates toward the printer head 15 can be reduced, and thus it is possible to reduce the stray light in a more reliable manner.

In this manner, it is preferable that the amount of light for each position in the LED module 25, that is, the amount of light for each of the areas divided into plural sections be appropriately set in accordance with a printing type, a device configuration, and a performance regarded as important.

In addition, in the ink-jet printers 1 according to the first to third embodiments, the ultraviolet irradiation device 20 includes the inner rows 21*in* and the outer rows 21*out* on both sides of the printer head 15 in the main-scanning direction, and the LED module 25 is provided thereto, respectively. However, the ultraviolet irradiation device 20 may be configured in a type other than the above-described type. When the LED light sources 26 of the LED module 25 are arranged to be close to the medium M, and the amount of light is set to be different in accordance with each arrangement position regardless of the configuration of the ultraviolet irradiation device 20, it is possible to make the reduction in the stray light and the flattening of the irradiation intensity of ultraviolet rays compatible with each other.

In addition, in the ink-jet printer 1 according to the second embodiment, the light absorption unit 41 is coated with a black diffuse reflection coating material, but the light absorption unit 41 may be subjected to a process other than the coating process. For example, the light absorption unit 41 may be subjected to surface texturing in order for a surface to have a concavo-convex shape. The type of the light absorption unit 41 does not matter as long as the light absorption unit 41 can absorb light from the medium M side without reflecting so much.

In addition, the ink that is ejected from the ejection units 16 of the printer head 15 is cured by ultraviolet rays included in light that is emitted from the LED light sources 26, and thus the light absorption unit 41 may be configured not to reflect, particularly, the ultraviolet rays in the light that reaches the light absorption unit 41 from the medium M side. For example, an ultraviolet absorbing agent that absorbs ultraviolet rays may be applied onto the light absorption unit 41. Specifically, a cerium oxide-based inorganic ultraviolet absorbing agent such as Needral (registered trademark) manufactured by Taki Chemical Co., Ltd. may be applied onto the light absorption unit 41. According to this, when receiving light reflected from the medium M side, the light absorption unit 41 can absorb ultraviolet rays included in the light, and thus it is possible to suppress unnecessary ultraviolet rays from being emitted in the printer head 15 from a space between the LED module 25 and the medium M, and it is possible to suppress the ultraviolet rays from being the stray light.

Figure 11:
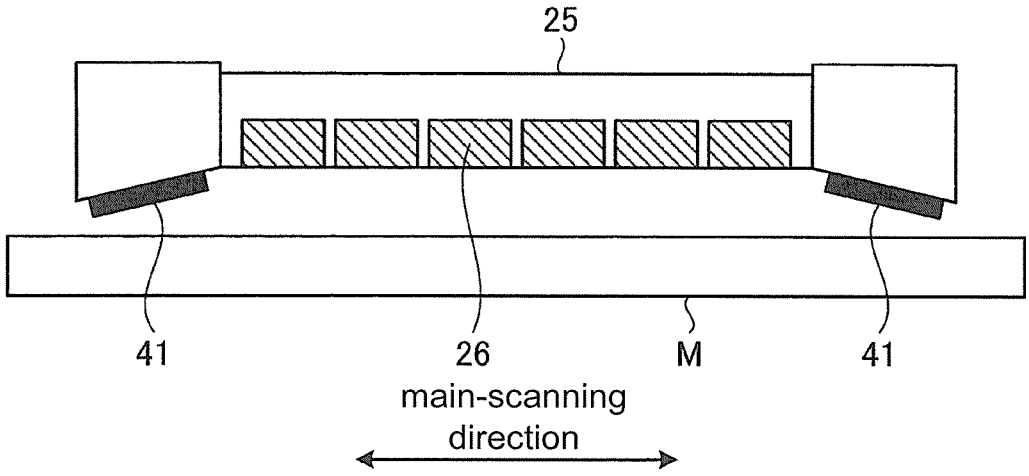
FIG. 11 is an explanatory view of a light absorption unit as a modification example of the ink-jet printer according to the second embodiment.

In addition, in the ink-jet printer 1 according to the second embodiment, the light absorption unit 41 is formed in a direction that is approximately parallel with the medium M, but the light absorption unit 41 may be formed in other directions. FIG. 11 is an explanatory view of a light absorption unit as a modification example of the ink-jet printer according to the second embodiment. For example, as shown in FIG. 11, as it is spaced away from the LED module 25 in the main-scanning direction, the light absorption unit 41 may be formed to be inclined in a direction closing to the medium M. When the light absorption unit 41 is inclined in the direction facing the LED module 25 side as described above, it is possible to reflect the light, which is not absorbed by the light absorption unit 41 and is reflected from the light absorption unit 41, toward a side at which the LED module 25 is located. According to this, it is possible to suppress the light, which propagates in the main-scanning direction while repeating reflection between the LED module 25 and the medium M, from getting out from a space therebetween, and propagating toward the printer head 15, and thus it is possible to reduce the stray light in a more reliable manner.

In addition, in the ink-jet printer 1 according to the third embodiment, a topology of the inner surface of the incident light capturing chamber 52 provided to the light capturing unit 50 is not particularly limited, but the type of the inner surface of the incident light capturing chamber 52 may be a type that is less likely to reflect light. The inner surface of the incident light capturing chamber 52 may be coated with a black diffuse reflection coating material similar to the light absorption unit 41 provided to the ink-jet printer 1 according to the second embodiment, may be subjected to the surface texturing to have a concavo-convex surface, or an ultraviolet absorbing agent may be applied onto the inner surface. According to this, when light, which enters the incident light capturing chamber 52, reaches the inner surface of the incident light capturing chamber 52, the inner surface is less likely to reflect the light, or can absorb ultraviolet rays. Accordingly, it is possible to capture the light, which enters the incident light capturing chamber 52 through the incidence unit 51, in the incident light capturing chamber 52 in a more reliable manner, or it is possible to absorb the ultraviolet rays. Accordingly, it is possible to reduce the stray light in a more reliable manner.

In addition, in the ink-jet printer 1 according to the second and third embodiments, the light absorption unit 41 or the incidence unit 51 of the light capturing unit 50 is arranged on both sides of the LED module 25 in the main-scanning direction. However, the light absorption unit 41 or the incidence unit 51 may be an installation type other than the above-described installation type. For example, the light absorption unit 41 or the incidence unit 51 may also be arranged on both sides of the LED module 25 in the sub-scanning direction. In addition, the light absorption unit 41 or the incidence unit 51 may also be arranged only at a position between the printer head 15 and the LED module 25 in the main-scanning direction. An installation type in other portions does not matter as long as the light absorption unit 41 or the incidence unit 51 is arranged at a position between the printer head 15 and the LED module 25 at least in the main-scanning direction.

In addition, the ink-jet printer 1 may be appropriately configured in combination of the configurations used in the above-described embodiments and modification examples, and the like, or may use a configuration other than the above-described configuration. When a plurality of LED light sources 26 are arranged at a position near the medium M, and the amount of light during light emission is set to be different in accordance with each arrangement position regardless of the configuration of the ink-jet printer 1, and the like, it is possible to perform irradiation of the ink-curing light while greatly reducing the stray light.

What is claimed is:

1. An ink-jet recording apparatus, comprising:

a printer head which moves relative to a table on which a medium is placed, and which ejects ink onto the medium while moving relative to the medium in a main-scanning direction, wherein the medium moves in the sub-scanning direction by a predetermined width in the sub-scanning direction which is defined as an one unit during printing by the printer head, and the printer head performs printing with the one unit set as one PASS;

irradiation means having a plurality of light-emitting diode modules for performing exposure with respect to the ink ejected onto the medium to cure the ink while moving together with the printer head in the main-scanning direction, wherein a temporary curing is performed by adjusting an amount of light from the light-emitting diode modules for exposure at a same PASS as the PASS at which the ink is ejected from the printer head, and a full curing is performed with respect to the ink on the medium that has been temporary cured by a previous PASS by exposure in an amount of light which is larger than the amount of light during the temporary curing in the previous PASS; and each of the light-emitting diode modules has a plurality of light-emitting units which are provided to the irradiation means at a position near the medium, which are plurally arranged at least in the main-scanning direction, and which are divided into a plurality of areas in accordance with an arrangement position with respect to the irradiation means to adjust an amount of light during light emission for each of the areas, wherein in each of the plurality of light-emitting diode modules, an outer peripheral portion corresponding to a strong light amount portion in a plan view of the light-emitting diode module has a larger amount of light than a center portion corresponding to a weak light amount portion of the light-emitting diode module, and the amount of light emitted to a portion of the medium, which faces the weak light amount portion, from other than the weak light amount portion, becomes larger than the amount of light emitted to another portion of the medium, which faces the strong light amount portion, from other than the strong light amount portion, and the medium in an irradiation range from one of the light-emitting diode module is irradiated with light in an uniform amount of light.

2. The ink-jet recording apparatus according to claim 1, further comprising:

light absorption means for absorbing light reflected from the medium, the light absorption means being located between the printer head and the irradiation means in the main-scanning direction.

3. The ink-jet recording apparatus according to claim 2, wherein the light absorption means is coated with a diffuse reflection coating material.

4. The ink-jet recording apparatus according to claim 2, wherein the light absorption means is coated with a black color.

5. The ink-jet recording apparatus according to claim 2, wherein an ultraviolet absorbing agent is applied onto the light absorption means.

6. The ink-jet recording apparatus according to claim 2, wherein a surface of the light absorption means is formed in a concavo-convex shape.

7. The ink-jet recording apparatus according to claim 1, further comprising:

an incidence unit which is located between the printer head and the irradiation means in the main-scanning direction, and which transmits light reflected from the medium; and an incident light capturing unit that captures light, which is transmitted through the incidence unit, on a medium side.

* * * * *